US009568017B2

(12) United States Patent
Hayashi et al.

(10) Patent No.: US 9,568,017 B2
(45) Date of Patent: Feb. 14, 2017

(54) QUIETER CENTRIFUGAL BLOWER WITH SUPPRESSED BPF TONE

(71) Applicants: DENSO International America, Inc., Southfield, MI (US); DENSO CORPORATION, Kariya-shi, Aichi-ken (JP)

(72) Inventors: Hiroyuki Hayashi, Kariya (JP); Justin Black, Novi, MI (US); Prakash Thawani, Bloomfield Hills, MI (US); Melissa Buczek, Orion, MI (US); Jie Zeng, Windsor (CA)

(73) Assignees: Denso International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 402 days.

(21) Appl. No.: 14/266,051

(22) Filed: Apr. 30, 2014

(65) Prior Publication Data

US 2015/0316070 A1 Nov. 5, 2015

(51) Int. Cl.

| | |
|---|---|
| ***F03B 3/04*** | (2006.01) |
| ***F04D 29/42*** | (2006.01) |
| ***F04D 29/66*** | (2006.01) |
| ***F04D 29/44*** | (2006.01) |

(52) U.S. Cl.

CPC ..... *F04D 29/4213* (2013.01); *F04D 29/441* (2013.01); *F04D 29/661* (2013.01); *F05D 2250/52* (2013.01)

(58) Field of Classification Search

CPC .. F04D 29/4213; F04D 29/441; F04D 29/661; F05D 2250/52

See application file for complete search history.

(56) References Cited

U.S. PATENT DOCUMENTS 5,141,397 A * 8/1992 Sullivan ..... F04D 29/4233 285/319
5,839,879 A 11/1998 Kameoka et al.
6,224,335 B1 5/2001 Parisi et al.
(Continued)

FOREIGN PATENT DOCUMENTS

DE 10004279 A1 8/2000
DE 60027393 T2 5/2007
(Continued)

OTHER PUBLICATIONS

Office Action dated Apr. 5, 2016 in corresponding JP Application No. 2015-077087 with English translation.
(Continued)

*Primary Examiner* — Jesse Bogue
(74) *Attorney, Agent, or Firm* — Harness, Dickey & Pierce, P.L.C.

(57) ABSTRACT

A centrifugal blower assembly including a ring-shaped planar portion and a sloped guide surface. The ring-shaped planar portion defines a central aperture at which a centrifugal fan is seated. The ring-shaped planar portion is elevated relative to a lower surface of a scroll casing. The sloped guide surface is between the ring-shaped planar portion and the lower surface of the scroll casing. The sloped guide surface slopes towards the lower surface, and extends in a downstream direction towards a partition of the scroll casing at a scroll starting position of the scroll casing.

16 Claims, 6 Drawing Sheets

(56) References Cited

U.S. PATENT DOCUMENTS

| | | | | |
|---|---|---|---|---|
| 6,450,767 | B2 * | 9/2002 | Nantt | A47L 5/14 415/197 |
| 6,881,031 | B2 * | 4/2005 | Nomura | F04D 29/441 415/154.1 |
| 7,500,825 | B2 * | 3/2009 | Hanai | F04D 29/4233 415/204 |
| 9,011,092 | B2 * | 4/2015 | Eguchi | F04D 29/4226 415/204 |
| 2004/0062646 | A1 * | 4/2004 | Nomura | F04D 29/441 415/206 |
| 2006/0171803 | A1 | 8/2006 | Senba | |
| 2006/0239815 | A1 | 10/2006 | Hanai | |
| 2013/0092357 | A1 | 4/2013 | Sato et al. | |

FOREIGN PATENT DOCUMENTS

| | | | |
|---|---|---|---|
| EP | 0846868 | A2 | 6/1998 |
| JP | H05-195995 | A | 8/1993 |
| JP | H09-310700 | A | 12/1997 |
| JP | 2014-001656 | A | 1/2014 |
| JP | 2015-212542 | A | 11/2015 |

OTHER PUBLICATIONS

Office Action dated Jan. 5, 2016 issued in the corresponding DE application No. 102015106056.6 in German with English translation.

* cited by examiner

QUIETER CENTRIFUGAL BLOWER WITH SUPPRESSED BPF TONE

FIELD

The present disclosure relates to a centrifugal blower.

BACKGROUND

This section provides background information related to the present disclosure, which is not necessarily prior art.

With reference to FIGS. 1 and 2, an existing blower assembly, such as a blower assembly for a heating, ventilation, and air conditioning (HVAC) unit for a vehicle, is generally illustrated at reference numeral 10. The blower assembly 10 generally includes a centrifugal fan 12 and a scroll casing 14. The centrifugal fan 12 defines an air inlet 20 at a center thereof for receipt of airflow A. The centrifugal fan 12 defines a plurality of air outlets 22 about an outer periphery thereof. A plurality of blades 24 are provided at the air outlets 22 in order to direct airflow A exiting the air outlets 22. The centrifugal fan 12 rotates about an axis at an axial center of the air inlet 20.

The scroll casing 14 includes a side scroll casing 30, generally extending around a portion of the centrifugal fan 12 from a scroll starting position 32 to a scroll ending position 34. An air outlet 36 of the blower assembly 10 extends from the scroll ending position 34 to an outlet aperture 38 at which airflow A exits the blower assembly 10. The air outlet 36 defines the outlet aperture 38.

A window 40 is defined between the side scroll casing 30 and the centrifugal fan 12 proximate to the scroll starting position 32. At the scroll starting position 32 is a partition 42, which at least partially defines the window 40. The partition 42 generally separates or partitions the side scroll casing 30 from the air outlet 36, and can be any suitable partition, such as a vertical partition or nose. The partition generally extends vertically, such as along line B (FIG. 2) relative to a lower surface 44 of the scroll casing 14.

The lower surface 44 of the scroll casing 14 is generally recessed below a ring-shaped planar face 46. The ring-shaped planar face 46 at least partially defines a central aperture 48 (see FIG. 3, which includes the central aperture 48 and features according to the present teachings as described herein) at which the centrifugal fan 12 is seated. The ring-shaped planar face 46 thus generally surrounds the centrifugal fan 12. The ring-shaped planar face 46 and the lower surface 44 of the scroll casing 14 extend in generally parallel and spaced apart planes, with the ring-shaped planar face 46 extending in a plane above the lower surface 44, as particularly illustrated in the orientation of FIG. 2, for example.

Extending between the ring-shaped planar face 46 and the lower surface 44 is a sloped face 50. The sloped face 50 may extend directly from the ring-shaped planar face 46, or from an intermediate surface (not shown) therebetween, which may be angled or sloped toward the lower surface 44. The sloped face 50 slopes radially outward from the ring-shaped planar face 46 (or the intermediate surface) to the lower surface 44 at generally a constant slope in an area between the scroll starting position 32 and the scroll ending position 34.

The sloped face 50 includes a sloped transition portion 52 extending beyond the scroll ending position 34 in the direction of the outlet aperture 38, which is a downstream direction relative to airflow A flowing through the scroll casing 14 out from within the centrifugal fan 12. The sloped transition portion 52 angles radially inward towards the centrifugal fan 12 as the sloped transition portion 52 extends away from the scroll ending position 34 in the downstream direction. The sloped transition portion 52 extends to vertical sidewall 60, which may begin proximate to the partition 42 (as illustrated in FIG. 1) or downstream of the partition 42 closer to the outlet aperture 38.

A planar guide wall or surface 62 extends from the ring-shaped planar face 46 towards the partition 42. An outer edge of the planar guide surface 62 proximate to the air outlet 36 extends from the ring-shaped planar face 46 in generally a tangential direction to the partition 42. Thus at the partition 42, the planar guide surface 62 extends generally in a plane that is perpendicular to line B extending along a height of the partition 42, as illustrated in FIG. 2 for example.

As airflow A exits the air outlets 22, such as proximate to the partition 42, airflow A may contact the planar guide surface 62 and or the partition 42, thereby causing an airflow disruption D. The disruption D may generate a sound, which is generally undesirable. A blower assembly that eliminates or minimizes airflow disruptions, such as disruption D, and sounds associated therewith, would therefore be desirable.

SUMMARY

This section provides a general summary of the disclosure, and is not a comprehensive disclosure of its full scope or all of its features.

The present teachings provide for a centrifugal blower assembly including a ring-shaped planar portion and a sloped guide surface. The ring-shaped planar portion defines a central aperture at which a centrifugal fan is seated. The ring-shaped planar portion is elevated relative to a lower surface of a scroll casing. The sloped guide surface is between the planar ring-shaped surface and the lower surface of the scroll casing. The sloped guide surface slopes towards the lower surface, and extends in a downstream direction towards a partition of the scroll casing at a scroll starting position of the scroll casing.

The present teachings further provide for a centrifugal blower assembly including a ring-shaped planar portion and a sloped guide surface. The ring-shaped planar portion defines a central aperture at which a centrifugal fan is seated. The ring-shaped planar portion is elevated relative to a lower surface of a scroll casing. The sloped guide surface extends from the ring-shaped planar portion towards the lower surface of the scroll casing. The sloped guide surface slopes towards the lower surface and extends in a downstream direction to a partition of the scroll casing at a scroll starting position of the scroll casing. The sloped guide surface increases in width in the downstream direction.

The present teachings still further provide for a centrifugal fan and a scroll casing. The centrifugal fan defines an air inlet at a center of the centrifugal fan, a plurality of air outlets at an outer periphery of the centrifugal fan, and a plurality of blades at the air outlets. The scroll casing houses the centrifugal fan and includes a scroll starting position, a scroll ending position, and an air passage extending between the scroll starting and ending positions. The scroll ending position is downstream from the scroll starting portion relative to airflow through the scroll casing. An air outlet extends from the scroll ending portion. A partition is between the scroll starting position and the air outlet. A ring-shaped planar portion defines a central aperture at which the centrifugal fan is seated. The ring-shaped planar portion is elevated relative to a lower surface of the scroll casing. A sloped guide surface is adjacent to the ring-shaped planar portion and extends in a downstream direction to the partition. The sloped guide surface slopes downward and away from the ring-shaped planar portion towards the lower surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 3:
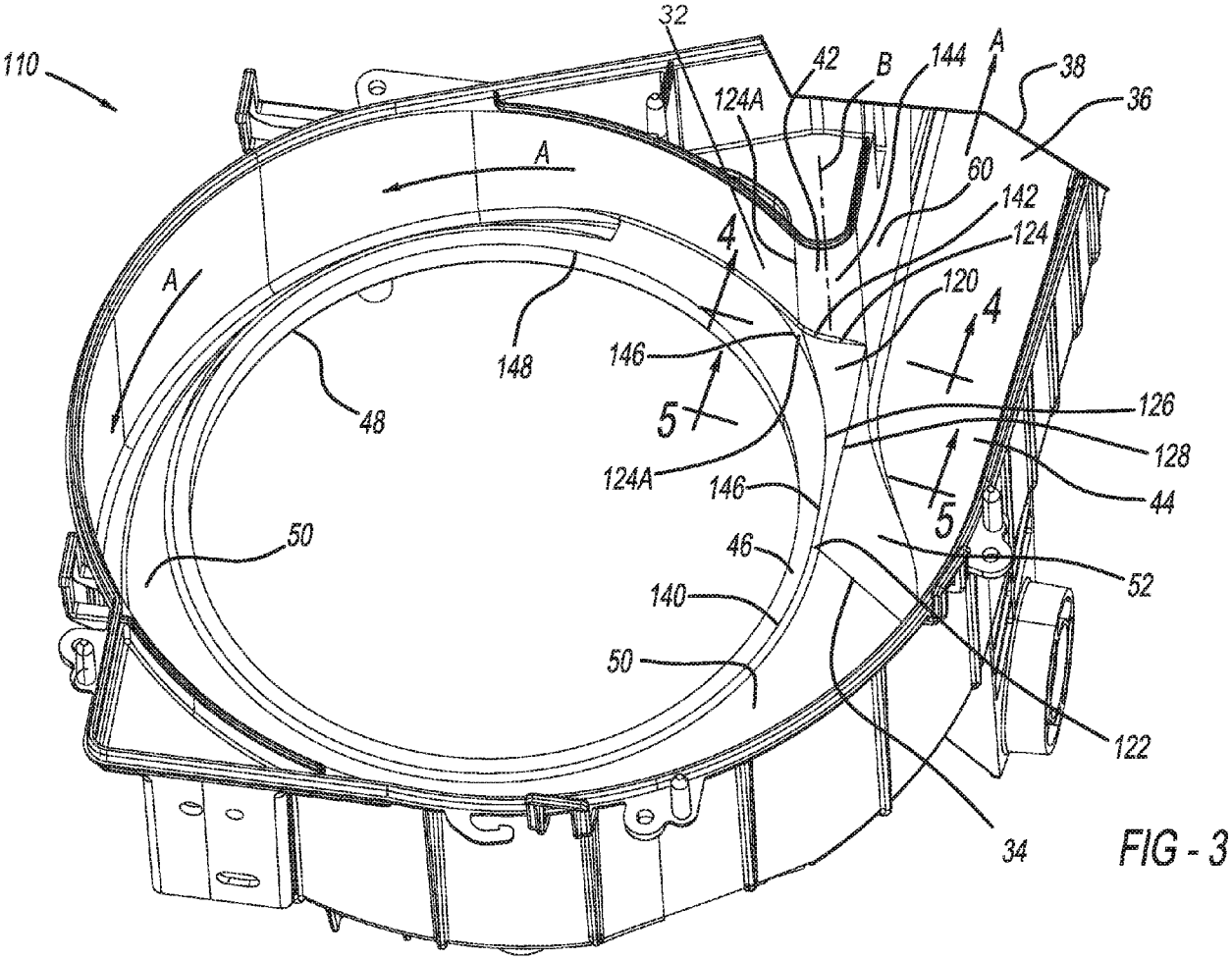
FIG. 3 is a perspective view of a blower assembly according to the present teachings.

With reference to FIG. 3, a blower assembly according to the present teachings is generally illustrated at reference numeral 110. Features of the blower assembly 110 that are similar to, or generally the same as, features of the blower assembly 10 are illustrated with like reference numbers. The description of the common features set forth above in the description of the blower assembly 10 also applies to the blower assembly 110.

Figure 1:
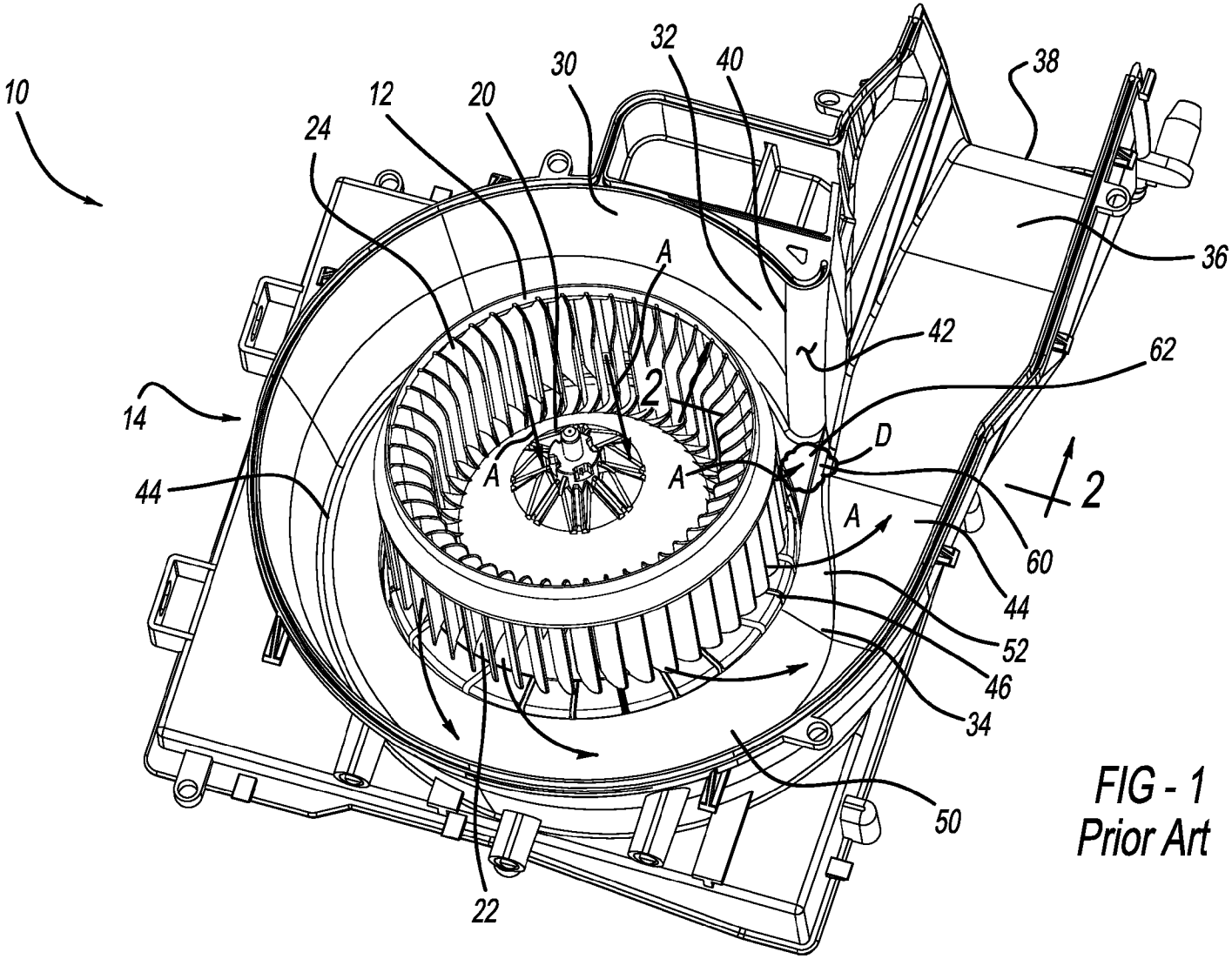
FIG - 1 Prior Art
FIG. 1 is a perspective view of a prior art blower assembly.
Figure 2:
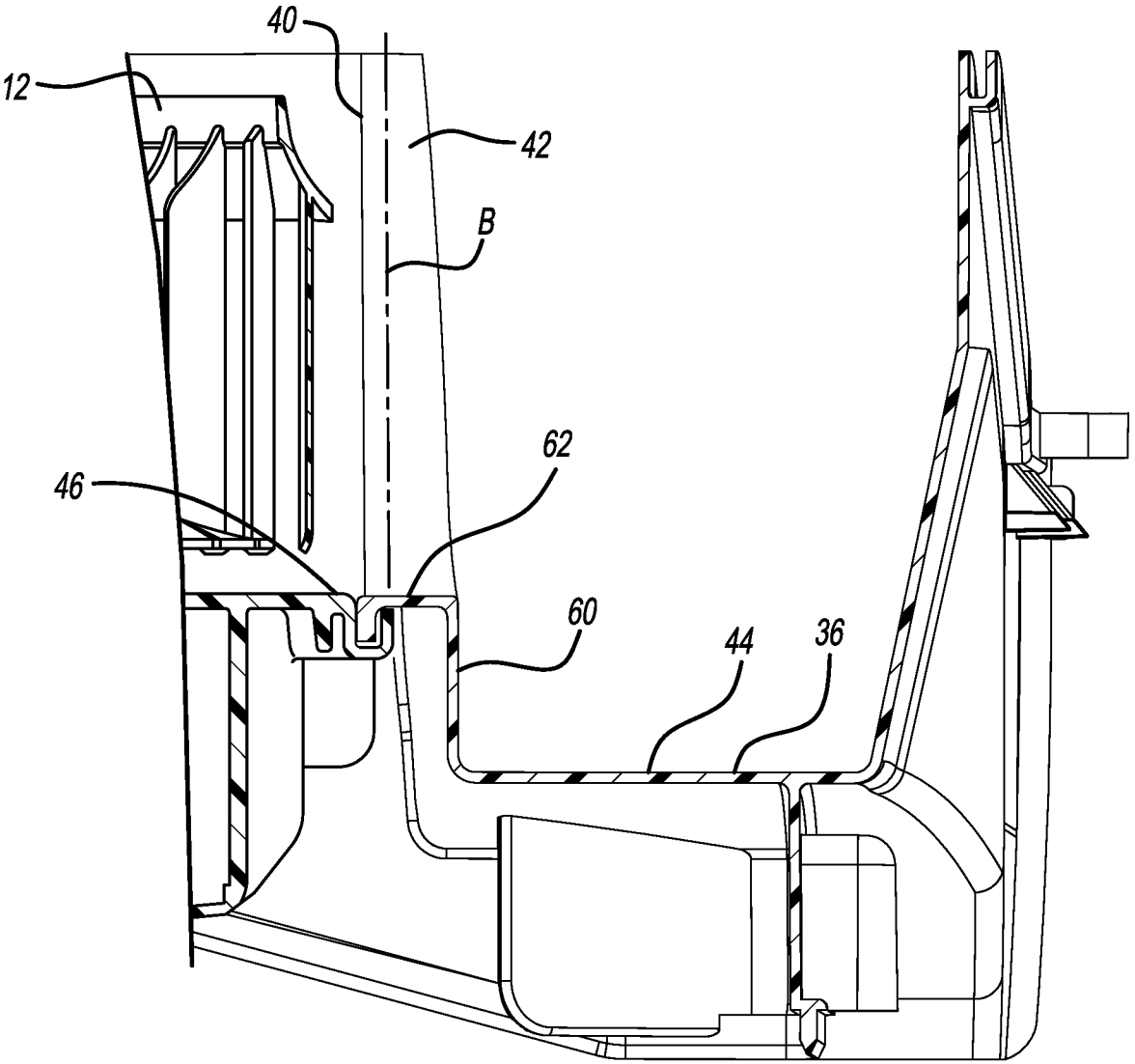
FIG - 2 Prior Art
FIG. 2 is a cross-sectional view taken along line 2-2 of FIG. 1.

The blower assembly 110 includes a sloped guide surface 120. The sloped guide surface 120 is in contrast to the planar guide surface 62 of the blower assembly 10 of FIGS. 1 and 2. The sloped guide surface 120 generally includes an upstream end 122 and a downstream end 124 at opposite ends of the sloped guide surface 120. The upstream end 122 is upstream of the downstream end 124 with respect to the direction of airflow A through the blower assembly 110. The upstream end 122 is generally at scroll ending position 34, and adjacent to a semi-ring shaped transition zone 140 between the ring-shaped planar face 46 and the sloped face 50. From the upstream end 122 the sloped guide surface 120 extends downstream to the downstream end 124, which is at a base 142 of the partition 42. The base 142 is at a face 144 of the partition 42. The downstream end 124 may extend past the partition 42 along a side thereof, such as to downstream end 124A which extends to or through the window 40. As described herein, such as in conjunction with the teachings of FIG. 8, the downstream end 124 may also extend past the partition 42 on a side thereof at the air outlet 36, such as to downstream end 124B.

The sloped guide surface 120 further includes an inner edge 126 and an outer edge 128, which is opposite to the inner edge 126. The inner edge 126 is adjacent to an outer edge 146 of the ring-shaped planar face 46. The outer edge 146 of the ring-shaped planar face 46 is generally opposite to an inner edge 148 of the ring-shaped planar face 46, which defines the central aperture 48. The outer edge 128 of the sloped guide surface 120 is at the transition portion 52 of the sloped face 50. The sloped guide surface 120 is most narrow between the inner and outer edges 126 and 128 at the upstream end 122, and is widest at the downstream end 124.

Figure 4:
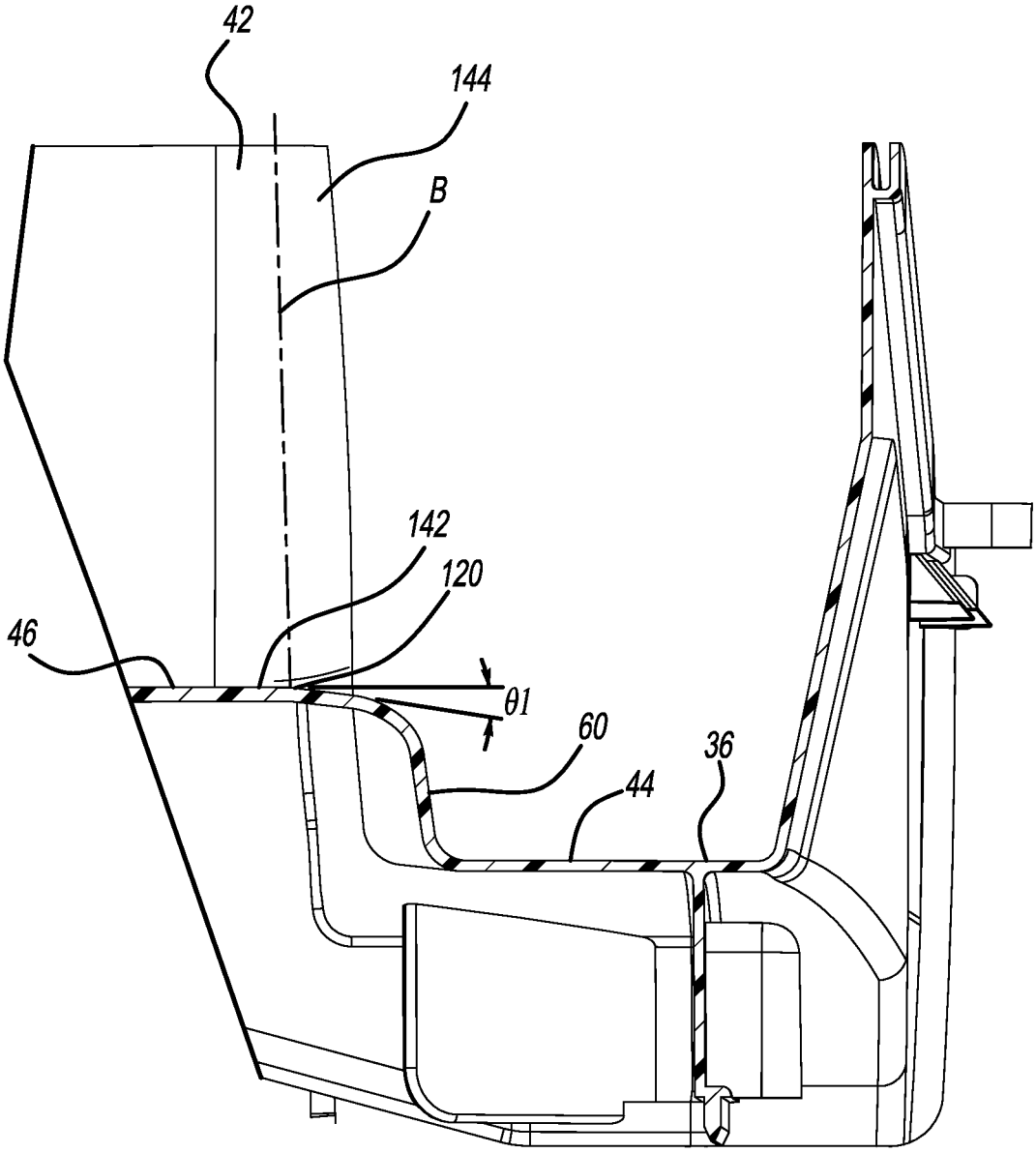
FIG. 4 is a cross-sectional view taken along line 4-4 of FIG. 3.
Figure 5:
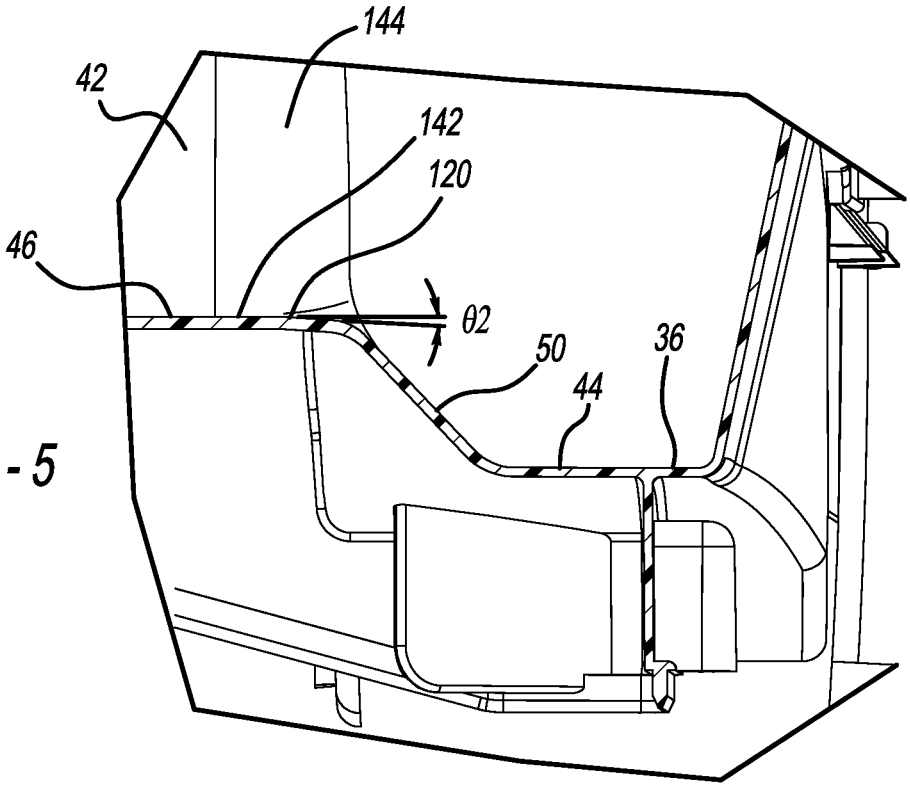
FIG. 5 is a cross-sectional view taken along line 5-5 of FIG. 3.
Figure 6:
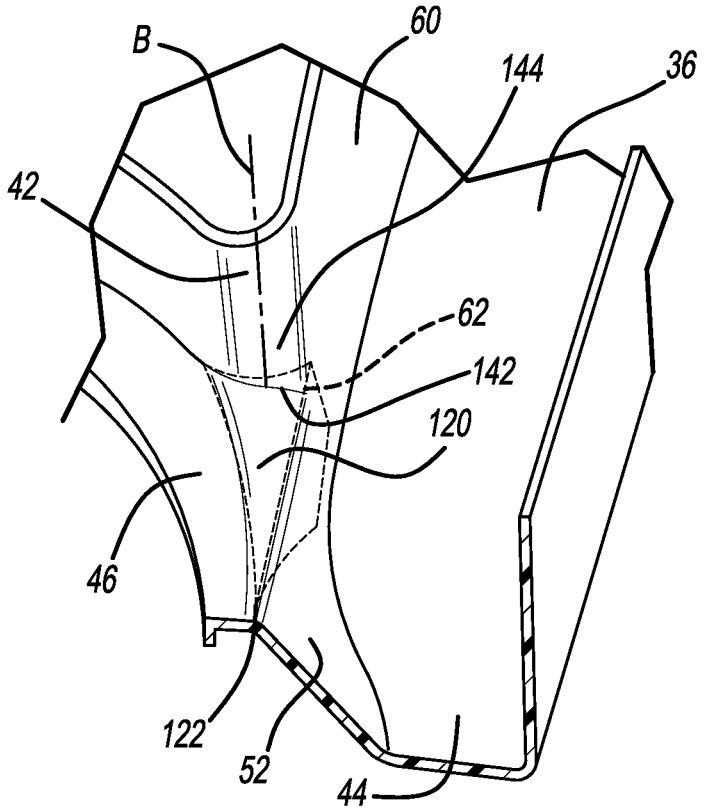
FIG. 6 is a perspective view of a sloped guide surface according to the present teachings, with dimensions of a planar guide surface of FIG. 1 overlaid thereon in phantom for comparison.

The sloped guide surface 120 generally slopes outward, such as radially outward, from the inner edge 126 to the outer edge 128 thereof. In general, the sloped guide surface 120 slopes outward and downward in the direction of the lower surface 44 of the scroll casing 14. Thus at the base 142 of the partition 42, the downstream end 124 of the sloped guide surface 120 is non-orthogonal to the line B extending along the height of the partition 42. As illustrated in FIG. 4 for example, at cross-section 4-4 of FIG. 3 taken proximate to the face 144 of the partition 42, the sloped guide surface 120 is angled at an angle $\theta 1$ relative to the ring-shaped planar face 46. Angle $\theta 1$ may be any suitable angle, such as 15° or about 15°, such as within 3° of 15°. As illustrated in FIG. 5 for example, at cross-section 5-5 of FIG. 3 taken upstream of the cross-section 4-4, the sloped guide surface 120 is angled at an angle $\theta 2$ relative to the ring-shaped planar face 46. Angle $\theta 2$ may be any suitable angle, such as 5° or about 5°, such as within 3° of 5°. Angle $\theta 2$ may be less than angle $\theta 1$, the same as angle $\theta 1$, or about the same as angle $\theta 1$. Thus, the slope of the sloped guide surface 120 from the inner edge 126 to the outer edge 128 may increase from the upstream end 122 to the downstream end 124. FIG. 6 illustrates the sloped guide surface 120 with the planar guide surface 62 of FIGS. 1 and 2 overlaid thereon for comparison.

Figure 7:
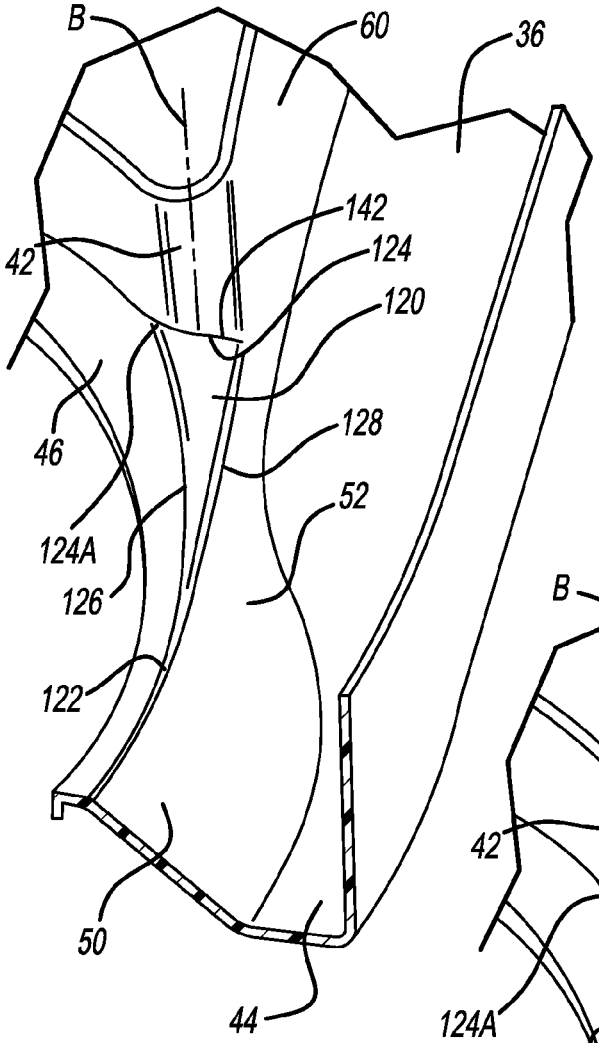
FIG. 7 is a perspective view of the sloped guide surface according to the present teachings and surrounding portions of the blower assembly of FIG. 3.

As illustrated in FIGS. 3 and 7 for example, at the outer edge 128 of the sloped guide surface 120, the sloped guide surface 120 transitions to the transition portion 52 of the sloped face 50. At the scroll ending position 34 the transition portion 52 extends radially to a distance that is equal to, or about equal to, the distance that the sloped face 50 extends. In the downstream direction towards the outlet aperture 38, the transition portion 52 extends progressively less from sloped guide surface 120, and thus gradually slopes inward in the downstream direction. At the partition 42, the transition portion 52 can terminate and become generally flush with, or transition into, the vertical sidewall 60, which defines a side of the air outlet 36.

Figure 8:
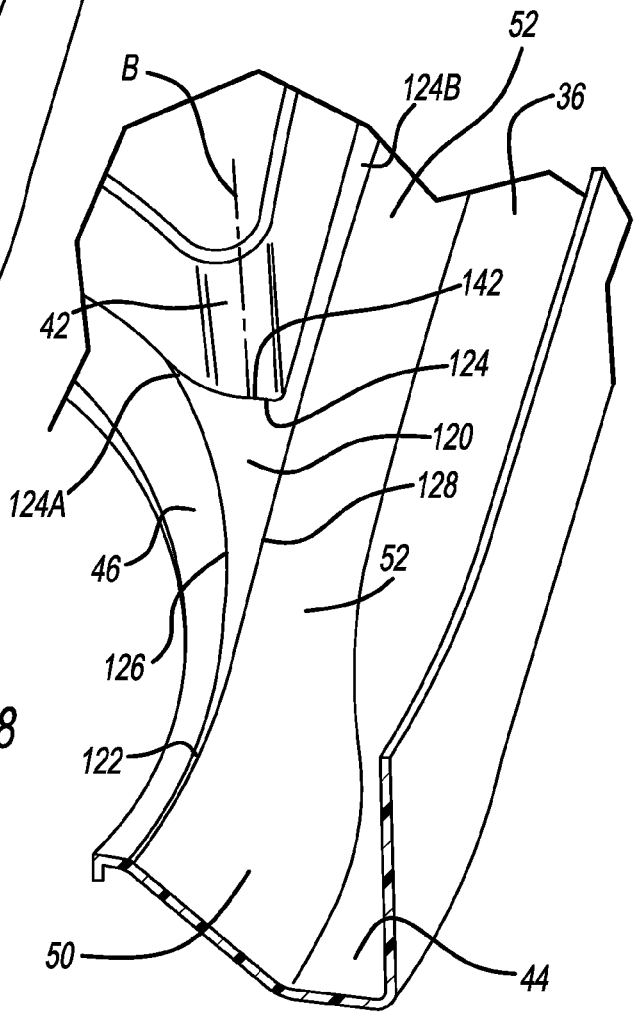
FIG. 8 is a perspective view of another sloped guide surface according to the present teachings and surrounding portions of another blower assembly according to the present teachings.

Alternatively and with reference to FIG. 8 for example, the transition portion 52 may extend further downstream and beyond the partition 42. For example, the transition portion 52 may taper inward towards the sloped guide surface 120 proximate to the partition 42, but not entirely to the vertical sidewall 60, and then extend beyond the partition 42 in the downstream direction towards the outlet aperture 38. The transition portion 52 may extend linearly beyond the partition 42, taper outward beyond the partition 42, or taper inward beyond the partition 42. FIG. 8 also illustrates the sloped guide surface 120 extending beyond the partition 42 to downstream end 124B in the air outlet 36 towards the outlet aperture 38.

The sloped guide surface 120, and/or the sloped transition portion 52 extending beyond the partition 42, according to the present teachings direct airflow A to the air outlet 36 and away from the partition 42 to eliminate or minimize airflow disruption D and resulting noises in the area of the sloped guide surface 120 and the partition 42. The blower assembly 110 according to the present teachings is thus quieter as compared to the blower assembly 10 of FIGS. 1 and 2, for example.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A centrifugal blower assembly comprising:

a ring-shaped planar portion defining a central aperture at which a centrifugal fan is seated, the ring-shaped planar portion is elevated relative to a lower surface of a scroll casing; and a sloped guide surface between the ring-shaped planar portion and the lower surface of the scroll casing, the sloped guide surface sloping towards the lower surface, and extending towards a partition of the scroll casing located between an air outlet of the blower assembly and a side scroll casing that curves around at least a portion of the central aperture;

wherein the sloped guide surface extends completely to the partition, and the sloped guide surface extends beyond both sides of the partition.

2. The centrifugal blower assembly of claim 1, wherein the sloped guide surface extends directly from the ring-shaped planar portion.

3. The centrifugal blower assembly of claim 1, wherein between the sloped guide surface and the lower surface of the scroll casing is a transition portion of a sloped face extending towards the lower surface around a majority of the central aperture.

4. The centrifugal blower assembly of claim 3, wherein the transition portion slopes radially inward towards the central aperture in the downstream direction.

5. The centrifugal blower assembly of claim 1, wherein the partition is a vertical partition wall between the scroll starting position and an air outlet of the centrifugal blower assembly.

6. The centrifugal blower assembly of claim 1, wherein the sloped guide surface increases in width in the downstream direction.

7. The centrifugal blower assembly of claim 1, wherein the sloped guide surface extends completely to the partition from a scroll ending position of the scroll casing, the scroll ending position and a scroll starting position are spaced apart about the central aperture, the scroll starting position is at the partition and the scroll ending position is at the air outlet.

8. A centrifugal blower assembly comprising:

a ring-shaped planar portion defining a central aperture at which a centrifugal fan is seated, the ring-shaped planar portion is elevated relative to a lower surface of a scroll casing; and a sloped guide surface extending from the ring-shaped planar portion towards the lower surface of the scroll casing, the sloped guide surface sloping towards the lower surface and extending to a partition of the scroll casing located between an air outlet of the blower assembly and a side scroll casing that curves around at least a portion of the central aperture, the sloped guide surface increases in width in the downstream direction;

wherein the sloped guide surface extends beyond the partition to opposite sides of the partition.

9. The centrifugal blower assembly of claim 8, wherein the sloped guide surface extends directly from the ring-shaped planar portion.

10. The centrifugal blower assembly of claim 8, wherein between the sloped guide surface and the lower surface of the scroll casing is a transition portion of a sloped face extending towards the lower surface around a majority of the central aperture.

11. The centrifugal blower assembly of claim 10, wherein the transition portion slopes radially inward towards the central aperture in the downstream direction.

12. The centrifugal blower assembly of claim 8, wherein the partition is a vertical partition wall between the scroll starting position and the air outlet of the centrifugal blower assembly.

13. The centrifugal blower assembly of claim 8, wherein the sloped guide surface extends completely to the partition from a scroll ending position of the scroll casing, the scroll ending position and a scroll starting position are spaced apart about the central aperture, the scroll starting position is at the partition and the scroll ending position is at the air outlet.

14. A centrifugal blower assembly comprising:

a centrifugal fan defining an air inlet at a center of the centrifugal fan, a plurality of air outlets at an outer periphery of the centrifugal fan, and a plurality of blades at the air outlets;

a scroll casing housing the centrifugal fan and including:

a scroll starting position, a scroll ending position, and an air passage extending between the scroll starting and ending positions, the scroll starting position and the scroll ending position are spaced apart about the air inlet;

an air outlet extending from the scroll ending portion;

a partition located between the air outlet of the blower assembly and a side scroll casing that curves around at least a portion of the central aperture;

a ring-shaped planar portion defining a central aperture at which the centrifugal fan is seated, the ring-shaped planar portion is elevated relative to a lower surface of the scroll casing; and a sloped guide surface adjacent to the ring-shaped planar portion and extending in a downstream direction to the partition, the sloped guide surface sloping downward away from the ring-shaped planar portion towards the lower surface;

wherein:

the sloped guide surface extends beyond the partition to opposite sides of the partition; and the scroll starting position is at the partition and the scroll ending position is at the air outlet.

15. The centrifugal blower assembly of claim 14, wherein the sloped guide surface is directly adjacent to the ring-shaped planar portion.

16. The centrifugal blower assembly of claim 14, wherein the sloped guide surface extends completely to the partition and increases in width in the downstream direction.

* * * * *